US006769633B1

(12) United States Patent
Huang

(10) Patent No.: US 6,769,633 B1
(45) Date of Patent: Aug. 3, 2004

(54) 360-DEGREE SPRINKLER HEAD

(75) Inventor: Chien-Lung Huang, 3F, No. 45, Lane 360, Chung-Jeng Road, Banchiau City, Taipei Hsien (TW)

(73) Assignee: Chien-Lung Huang

( * ) Notice: Subject to any disclaimer, the term of this patent is extended or adjusted under 35 U.S.C. 154(b) by 0 days.

(21) Appl. No.: 10/417,983

(22) Filed: Apr. 15, 2003

(51) Int. Cl.[7] ..... B05B 1/32

(52) U.S. Cl. ..... 239/457; 239/513; 239/514; 239/600; 239/DIG. 1; 239/460

(58) Field of Search ..... 239/456, 457, 239/458, 600, 200, 201, 451, 455, 460, 581.1, 581.2, 513, 514, 511, 512, DIG. 1

(56) References Cited

U.S. PATENT DOCUMENTS 4,579,285 A * 4/1986 Hunter ..... 239/457
6,145,758 A * 11/2000 Ogi ..... 239/457
6,443,372 B1 * 9/2002 Hsu ..... 239/457

* cited by examiner

*Primary Examiner*—Michael Mar
*Assistant Examiner*—Dinh Q. Nguyen

(57) ABSTRACT

A 360-degree sprinkler head is comprised of a main member, an adjustment ring, a cap and a lock bolt. The main member is a hollow cylinder consisting of an annular member positioned at the center with a plurality of coupling tabs integrated to the hollow cylinder and a stepped edge disposed at the upper end of the hollow cylinder. The adjustment ring has a plurality of coupling tines along its lower side conjoined to a round nut constituting a stepped annular member, a helical rib proceeding around the surface opening at the upper end of the annular member, and a beveled surface articulated as an outlet along the inner edge of the helical rib. The cap is a funnel-shaped cover member consisting of a threaded section and a spigot tube sequentially formed at the middle lower section, a passage through the center of the entire cover member, and a plurality of slots disposed at intervals in the outer wall of the spigot tube, with a lip formed along the outer periphery of the spigot tube.

3 Claims, 4 Drawing Sheets

360-DEGREE SPRINKLER HEAD

BACKGROUND OF THE INVENTION

1) Field of the Invention

The invention herein relates to a water sprinkler device, specifically an improved structure of 360° sprinkler head that provides a directly rotatable cap affording 360 degrees of control over sprinkled water to delineate the angular coverage range of the spray such that water is sprinkled in an evenly distributed pattern. At the same time, the height of the said cap remains unchanged as it is rotated 360 degrees.

2) Description of the Prior Art

Manufacturers have released 360° sprinkler heads (including that of the Taiwan Patent Publication No. 421,085 filed under application No. 88,213,412 on Aug. 9, 1999 and publicly disclosed on Feb. 1, 2001 as well as, that of the U.S. Pat. No. 4,579,285 filed on Apr. 19, 1984 and publicly disclosed on Apr. 1, 1986) capable of spraying water at a full 360 degrees coverage without dead angles to achieve a circular sprinkling pattern. Although more progressive and practical than prior conventional rotating-type sprinkler units, the 360° sprinkler heads of the said Taiwan Patent Publication No. 421,085 (referred to hereafter as Exhibit 1) and U.S. Pat. No. 4,579,285 (referred to hereafter as Exhibit 2) still have structural design flaws that are manifested in the following drawbacks:

1. With Exhibit 1, the angular coverage range of sprinkling is adjusted by directly rotating the cap. However, the extent of angular coverage adjustment only ranges from 0 to 180°. To increase the range, a screwdriver is used to loosen the lock bolt, following which the sprinkling angular coverage range is 180° to 360°. Since a screwdriver is needed in order to undo the lock bolt, such an operation is rather impractical. Exhibit 2 has an adjustable angular coverage range of only 25° to 360° and, furthermore, since 0 and 360° are excluded from the angular coverage range adjustment, the unit is even more impractical.
2. When the caps of Exhibit 1 and Exhibit 2 are rotated to adjust the angular coverage range of sprinkling, they are displaced upward. When the caps are no longer used for sprinkling and retracted into their holding tubes, the upper edges of the said caps cannot be fully inserted into the said holding tubes, but only postured even with the upper extremities of the said storage tubes. As such, sand, dust, and other foreign matter easily enter the sprinkling orifices, resulting in sprinkling difficulties such as clogging.
3. Since Exhibit 1 and Exhibit 2 lack a baffle element 26, the angular coverage of sprinkled water cannot be delineated and, furthermore, easily results in a mixed output of unusable spray, dribble and leakage.
4. Exhibit 1 and Exhibit 2 also lack a current rectification structure or device, so they are incapable of sprinkling water in even segments, with the sprinkled pattern often broken, scattered, and unevenly distributed.

Given the numerous structural and design shortcomings of the said conventional 360° sprinkler heads, the applicant of the invention herein conducted extensive research and testing that culminated in the successful development of the 360° sprinkler head of the present invention.

SUMMARY OF THE INVENTION

The objective of the invention herein is to provide an improved structure of 360° sprinkler head having a rotatable cap that does not require a screwdriver for lock bolt adjustment, but affords selective control over an angular coverage range of 0° to 360°.

Another objective of the invention herein is to provide an improved structure of 360° sprinkler head in which a baffle element disposed on the adjustment ring is capable of delineating the angular coverage range of sprinkled water and, furthermore, does not generate a spray pattern on one side with drippage or squirting on the other side.

Yet another objective of the invention herein is to provide an improved structure of 360° sprinkler head in which the cap has a helical beveled surface proximal to its top extremity that operates in conjunction with a conical baffle ring, the arrangement serving as a "rectification" means that facilitates the sprinkling of an even umbrella or segment pattern that is not broken or scattered.

Still another objective of the invention herein is to provide an improved structure of 360° sprinkler head, wherein when the cap is rotated to effect spray adjustment, no upward displacement occurs and, furthermore, when not used for sprinkling, the cap is fully retractable into a holding tube, its upper extremity situated flush against the upper surface of the said holding tube, with the absence of intermediary gaps between the cap and the holding tube preventing the entry of sand, dust and foreign matter into the interior that results in sprinkling difficulties.

DETAILED DESCRIPTION OF THE INVENTION

Figure 1:
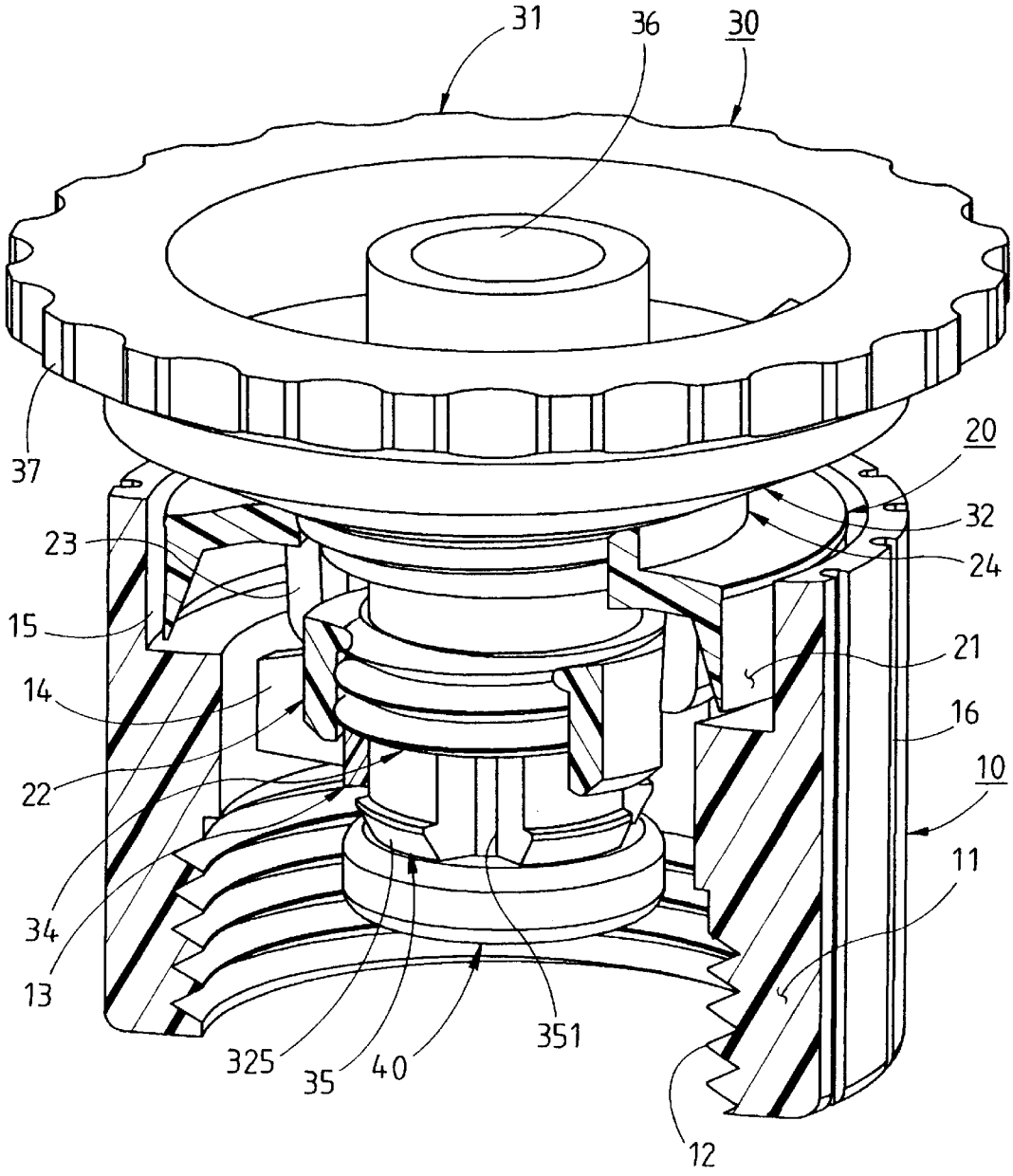
FIG. 1 is an isometric, partial cross-sectional drawing of the invention herein.
Figure 2:
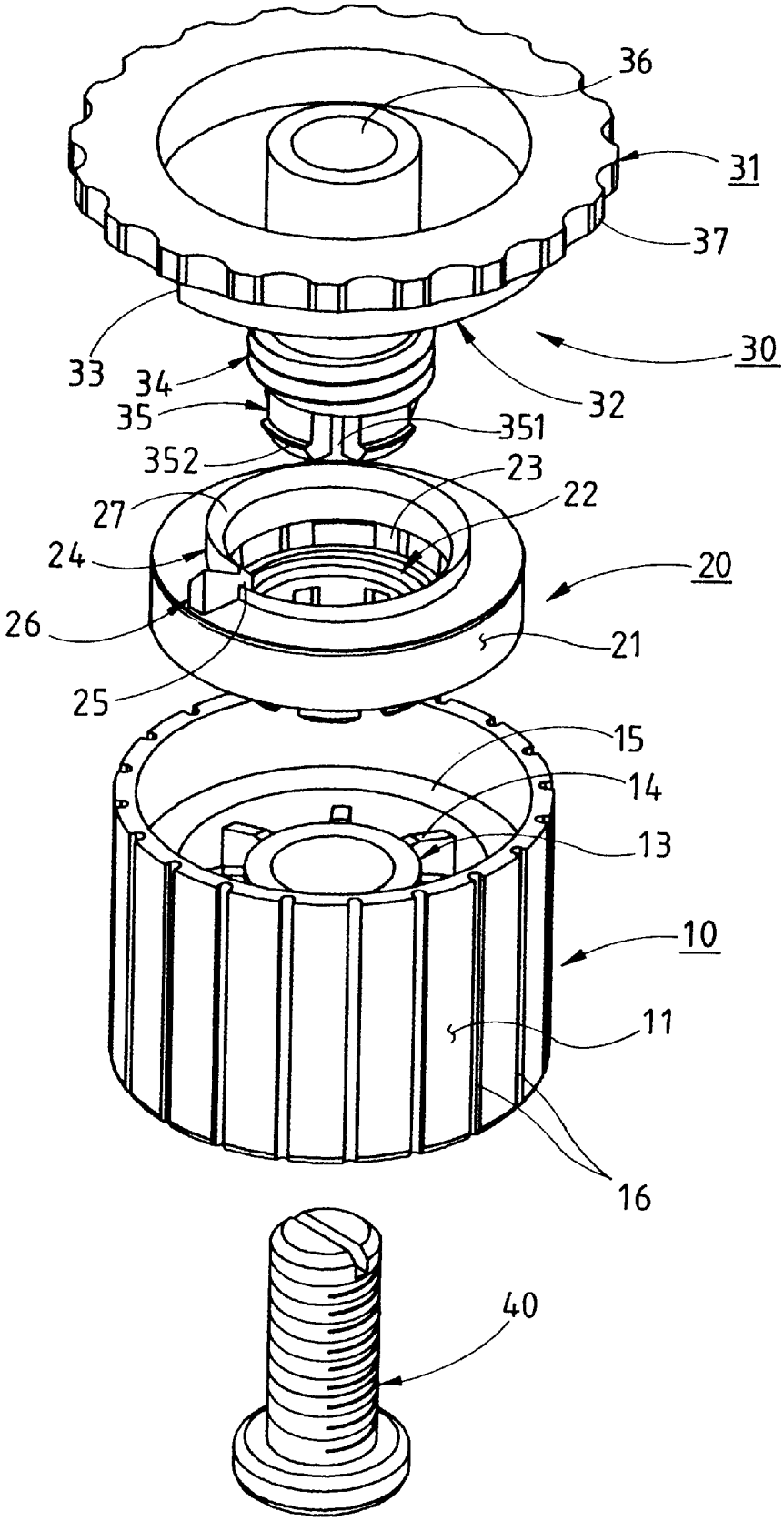
FIG. 2 is an exploded drawing of the invention herein.

Referring to FIG. 1 and FIG. 2, the 360° sprinkler head of the invention herein is comprised of a main member 10, an adjustment ring 20, a cap 30, and a lock bolt 40, wherein the said main member 10 supports the said adjustment ring 20 which rotatively seats the said cap 30, while the said lock bolt 40 passes through the main member 10 and is fastened into the bottom end of the cap 30 such that the said cap 30 and the main member 10 are conjoined into a single structural entity.

The said main member 10 is molded of plastic in a one-step casting process to form a hollow cylinder 11 having a threaded opening 12 along the inner side of the lower end, the said threaded opening 12 serving as a means of fastening to a water hose (not shown in the drawings); an annular member 13 positioned at the center with a plurality of coupling tabs 14 are integrated to the said hollow cylinder 11 that enables the conjoinment of the said annular member 13 to the cap 30; a stepped edge 15 is disposed along the inner circumference proximal to the upper end of the said hollow cylinder 11 that enables the seated insertion of the said adjustment ring 20; a plurality of vertical grooves 16 or ridges are formed lengthwise along the outer circumferential wall of the said hollow cylinder 11 that facilitates manual grasping during water hose fastening and unfastening.

The said adjustment ring 20 is molded of plastic in a one-step casting process to form an annular member 21 having a plurality of coupling tines 23 along its lower side conjoined to one round nut 22 with a minimum of one thread thereon for constituting a stepped annular member; a helical rib 24 proceeds around the surface opening at the upper end of the said annular member 21 and, furthermore, a stop 25 and a protruding baffle element 26 are respectively disposed at its confluent lowest and highest points; at the same time, a beveled surface 27 is articulated along the inner edge of the said helical rib 24.

Figure 5:
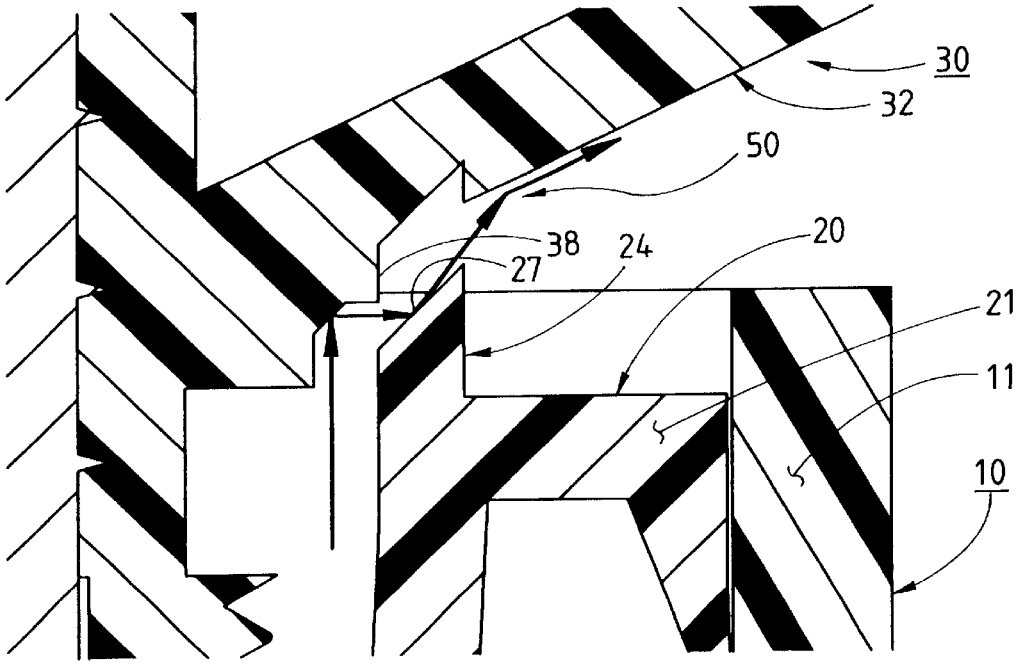
FIG. 5 is a magnified cross-sectional drawing of the invention herein illustrating the spewing action during sprinkling.

The said cap 30 is molded of plastic in a one-step casting process to form a funnel-shaped cover member 31; the said cover member 31 having a helical beveled surface 32 is formed around the lower surface of its upper portion, with a stop 33 disposed at the confluent lowest and highest points of the said beveled surface 32; a threaded section 34 and a spigot tube 35 are sequentially formed at the middle, lower section of the cover member 31 and, furthermore, a passage 36 penetrates through the entire cover member 31 that traverses the center of the said threaded section 34 and the spigot tube 35 for the installation of the lock bolt 40; a plurality of slots 351 are disposed at intervals in the outer wall of the said spigot tube 35, with a lip 352 formed along its outer periphery, enabling the said spigot tube 35 to contract for smooth insertion into the annular member 13 of the main member 10 and since the said spigot tube 35 is fabricated of an elastic material that automatically expands upon the release of pressure, the said lip 352 comes to rest against the lower edge of the said annular member 13 (as shown in FIG. 1), thereby conjoining the cap 30 to the said main member 10; the said cover member 31 also has a plurality of protrusions 37 arrayed along the fluting molded into the circumference at its top end to facilitate manual grasping by the user during rotational adjustment. Additionally, to enable the improved structure of 360° sprinkler head of the invention herein to emit an even umbrella or segment pattern during operation, a conical baffle ring 38 (as shown in FIG. 5) is disposed at the lower edge of the helical beveled surface 32 in the cover member 31 such that water first strikes the said conical baffle ring 38, where it is "rectified" into an equalized flow to facilitate the sprinkling of an even umbrella or segment pattern that is not broken or scattered.

Figure 3:
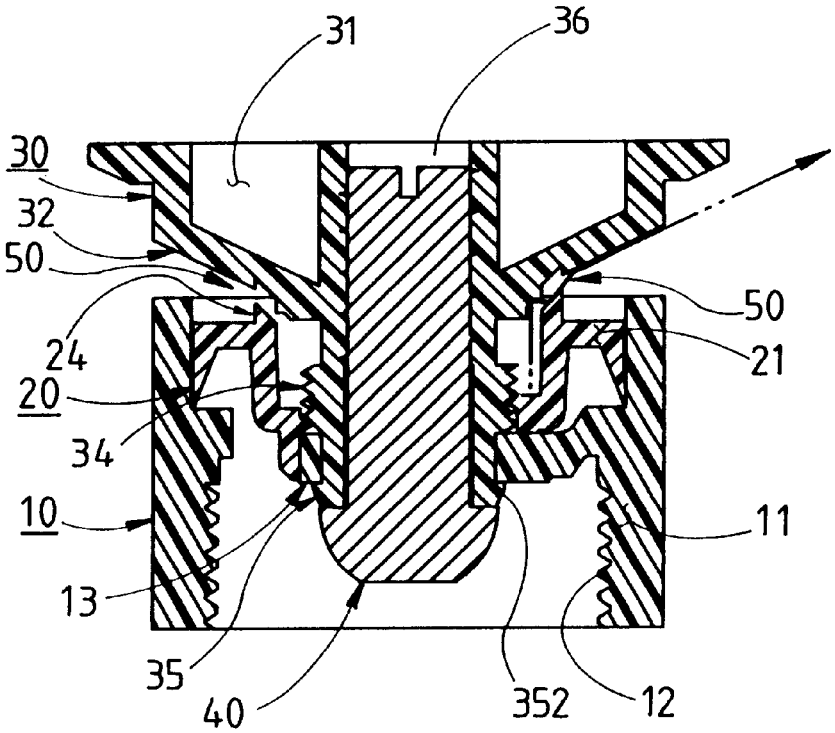
FIG. 3 is a cross-sectional drawing of the invention herein in the sprinkling-enabled mode.
Figure 4:
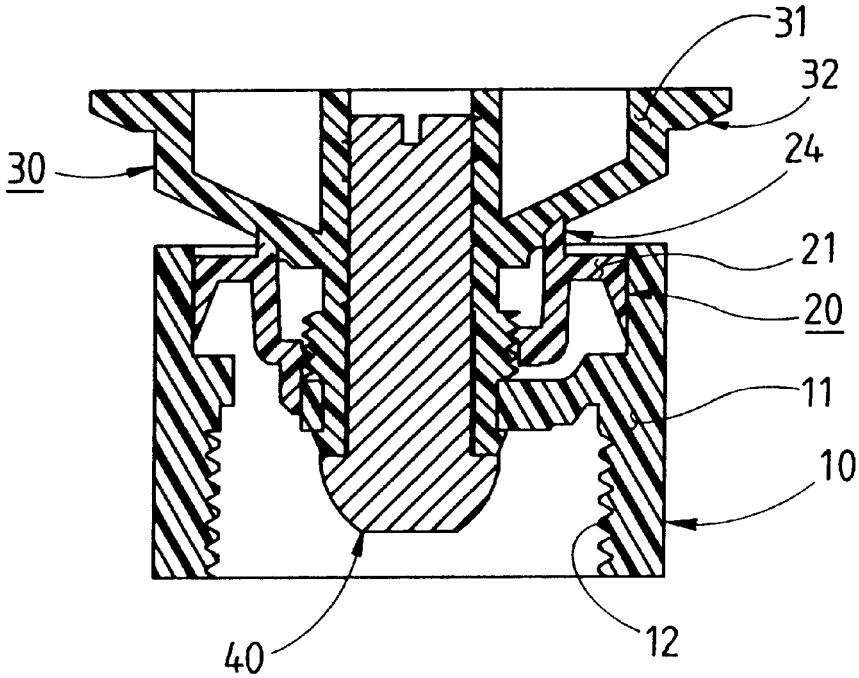
FIG. 4 is a cross-sectional drawing of the invention herein in the sprinkling-disabled mode.

Referring to FIG. 1, FIG. 3, and FIG. 4, to assemble the improved structure of 360-degree sprinkler head of the invention herein, the adjustment ring 20 is placed onto the stepped edge 15 of the main member 10; the threaded section 34 on the said cap 30 is fastened into the round nut 22 on the adjustment ring 20 and, furthermore, such that the spigot tube 35 at the lower end of the said threaded section 34 is inserted into the annular member 13 of the said main member 10 and the lip 352 on the said spigot tube 35 engages the lower end surface of the said annular member 13, enabling the said main member 10, adjustment ring 20, and cap 30 to become a single unitary entity; finally, the lock bolt 40 is inserted upward through the lower extent of the said main member 10 and fastened into the passage 36 transversing the threaded section 34 and the spigot tube 35 of the said cap 30 to prevent the contraction and upward dislodging of the said spigot tube 35; as such, the improved structure of 360-degree sprinkler head of the invention herein is thereby fully assembled into a completed product ready for installation and utilization.

Referring to FIG. 3, FIG. 4 and FIG. 2, in the improved structure of 360-degree sprinkler head of the invention herein, the threaded opening 12 along the inner side of the lower end of the main member 10 is fastened to the end connector of a water hose (not shown in the drawings) for water sprinkling. However, when the cap 30 is rotatively tightened to move the adjustment ring 20 upward to the endpoint position, the stop 25 on the said adjustment ring 20 becomes situated flush against the stop 33 on the helical beveled surface 32 of the said cap 30, effectively preventing the cap 30 from rotating, at which time the beveled surface 27 articulated as an outlet along the inner edge of the said helical rib 24 of the said adjustment ring 20 is postured against the helical beveled surface 32 on the said cap 30, while the inner edge of the said helical rib 24 is positioned within the conical baffle ring 38 on the said helical beveled surface 32, thereby establishing a sealed state (as shown in FIG. 4) that prevents water flow through an orifice 50 (as shown in FIG. 3) between the said cap 30 and the adjustment ring 20; this is the sprinkling-disabled mode. When the said cap 30 is rotatively loosened to move the adjustment ring 20 downward, the beveled surface 27 articulated as an outlet on the said adjustment ring 20 that was originally postured against the helical beveled surface 32 of the cap 30 forms the orifice 50 (as shown in FIG. 3), allowing water to flow through the said orifice 50 for sprinkling operation; furthermore, the baffle element 26 on the helical rib 24 of the said adjustment ring 20 delineates the angular coverage range of the spray, with the specific angular coverage of the spray controlled by rotating the said cap 30 at a proportional number of degrees (for example, rotating the cap 30 at 15 degrees results in a sprayed fan pattern having a total angular coverage of 15 degrees; rotating it at 30 degrees yields a sprayed fan pattern having a total angular coverage of 30 degrees, and so on.) When the said cap 30 is rotated 360 degrees, the stop 33 on the helical beveled surface 32 of the said cap 30 and the stop 25 on the helical rib 24 of the adjustment ring 20 converge; such up and down position provides for an orifice 50 that is circumferentially functional to thereby enable a 360-degree range of spraying operation. Since the cap 30 of the invention herein has a conical baffle ring 38 (as shown in FIG. 5) uniquely disposed at the lower edge of its helical beveled surface 32, during sprinkling operation at any angular coverage, water first strikes the said conical baffle ring 38, where it is "rectified" into an equalized flow to facilitate the emission of an even umbrella or segment pattern that is not broken or scattered.

What is claimed is:

1. A 360-degree sprinkler head comprising:

a main member, shaped like a hollow cylinder, consisting of:

an annular member positioned at a center thereof with a plurality of coupling tabs integrated to said hollow cylinder;

a stepped edge disposed at an upper end of said hollow cylinder;

an adjustment ring, formed as a stepped annular member, including:

a round nut at a lower side of said stepped annular member;

a helical rib proceeding around a surface opening at an upper end of said stepped annular member;

a beveled surface articulated as an outlet along the inner edge of said helical rib;

a cap, formed as a funnel-shaped cover member, consisting of:

a helical beveled surface formed around a lower surface of an upper portion thereof;

a threaded section and a spigot tube sequentially disposed at a middle lower section thereof;

a passage through a center of said threaded section and said spigot tube;

a plurality of slots disposed at intervals in an outer wall of said spigot tube;

a lip formed along an outer periphery of said spigot tube; and a lock bolt wherein said adjustment ring is placed onto said stepped edge of the main member and wherein said threaded section of said cap is fastened into said round nut on the adjustment ring so that said spigot tube at a lower end of said threaded section is inserted into said annular member of the main member and said lip on the spigot tube engages the lower end surface of said annular member, enabling said main member, said adjustment ring and said cap to become a single unitary entity, and finally said lock bolt is inserted upward through a lower extent of the main member and fastened into said passage to prevent the contraction and upward dislodging of said spigot tube.

2. As mentioned in claim 1, wherein said adjustment ring has a protruding baffle element disposed at confluent lowest and highest points of said helical rib.

3. As mentioned in claim 1, wherein a conical baffle ring is disposed at a lower edge of the helical beveled surface of said cap.

* * * * *